US005212876A

United States Patent [19]

Berit

[11] Patent Number: 5,212,876

[45] Date of Patent: May 25, 1993

[54] AUTOMATIC SPIN DRYER

[75] Inventor: Bradley I. Berit, Norfolk, Mass.

[73] Assignee: Sanborn, Inc., Wrentham, Mass.

[21] Appl. No.: 893,392

[22] Filed: Jun. 4, 1992

[51] Int. Cl.[5] ..... F26B 5/08

[52] U.S. Cl. ..... 34/58; 34/184

[58] Field of Search ..... 34/58, 56, 8, 184; 494/56, 64, 65, 84

[56] References Cited

U.S. PATENT DOCUMENTS 3,570,135 3/1971 Rousselet ..... 34/58

4,493,156 1/1985 Siegmann ..... 34/58

*Primary Examiner*—Henry A. Bennet

*Attorney, Agent, or Firm*—Cesari and McKenna

[57] ABSTRACT

An automatic drying apparatus for drying vegetables and the like includes a support having at least three upstanding posts with lateral spaces between the posts for providing clearance for a conveyor extending from the dryer in at least one of three directions. The housing is suspended by a pendulum-type suspension from the support, the housing having an annular bottom wall, a side wall and a top wall with an opening therein. An open top basket is rotatably mounted in the housing, the basket having a cylindrical side wall and a conical bottom wall which is moveable along a vertical axis between a closed position wherein it engages the basket side wall and an open position wherein it is spaced appreciably below the basket side wall so that the contents of the basket can drop out of the basket onto a conveyor. The moving means for moving of basket bottom wall between its two positions are suspended below the basket bottom wall to minimize the height of the apparatus.

8 Claims, 2 Drawing Sheets

AUTOMATIC SPIN DRYER

FIELD OF THE INVENTION

This invention relates to apparatus for effecting separations involving bulky materials which do not have a propensity to pack. It relates more particularly to an automatic spin dryer especially suitable for dewatering and drying leafy vegetables such as spinach, lettuce, cole slaw, and the like.

BACKGROUND OF THE INVENTION

Centrifugal separators or spin dryers of this general type include a basket rotatably mounted to a support so that the axis of rotation is more or less vertical. The basket usually has a bottom wall, perforate side walls and open top. The material to be dried or otherwise processed is dropped into the basket and the basket is rotated. The resulting centrifugal force thrusts the basket contents radially outward. The solid material is captured by the basket side walls, while any liquid in the basket passes through those walls and is drained away. After a period of time sufficient to substantially dry the solid material in the basket, the basket is stopped and the dried material is removed from the basket.

There exists in the prior art spin dryers that are particularly suited to drying vegetables. A typical such dryer incorporates a rotary basket whose bottom wall is conical and moveable vertically along the axis of rotation of the basket between an upper or closed position wherein the periphery of the conical bottom wall forms a seal with the basket side walls and an open or lower position wherein the bottom wall is spaced well below the basket side walls. At the beginning of the spin cycle, the bottom wall is moved to its closed position and the material to be dried is dropped into the basket from above. The basket is then spun for a selected period of time to dry that material as described above. At the end of the spin cycle, the bottom wall is moved to in its open position allowing the dried material to drop from the basket into a container or onto a conveyor belt. That particular dryer thus simplifies the loading and unloading of the dryer.

However, that prior dryer has several disadvantages which militate against its wider use and application. First, the dryer per se is suspended from an A-frame support structure which limits the direction in which material can be conveyed to and from that dryer. In other words, the dryer basket can only be approached between the A-frames. The support structure also has a relatively large foot print so that the dryer takes up a large amount of floor space in the building in which it is situated.

Another problem with that prior type spin dryer is that the basket bearing housing is mounted to its support by way of a rubber bumper and spherical seat. Accordingly, the dryer tends to vibrate excessively, particularly when carrying an unbalanced load.

Spin dryers with moveable basket bottom walls are disadvantaged also because the bottom wall is invariably mounted at the lower end of a long piston rod that moves the wall between its open and closed positions. Resultantly, when the basket is rotated with that wall in its open position, as occurs at the end of a spin cycle, the shaft experiences shaft run-out which places a considerable amount of stress on the connection between the basket bottom wall and the shaft. Resultantly, fractures may occur at that location necessitating relatively frequent maintenance and repair of the dryer. Often, such repair is difficult because most of the motors and mechanical connections in the prior dryer are located within the A-frame support structure so that they are relatively inaccessible. Consequently, such maintenance and repairs can result in a considerable amount of dryer downtime.

Still further, the pneumatic cylinder portion of the pistion that moves the basket wall usually extends well above the basket, being supported by the A-frame support structure, thereby increasing the overall height of the dryer. For a large capacity dryer which may have a basket diameter as large as four feet, this means that the overall height of the dryer may extend well above eight feet, making it impractical to house the dryer in a building with a standard ceiling height.

SUMMARY OF THE INVENTION

Accordingly, the present invention aims to provide an improved basket-type centrifugal separator or spin dryer.

Another object of the invention is to provide apparatus of this type which is relatively compact and which can fit in a building with a standard ceiling height.

A further object of the invention is to provide a spin dryer especially suited for drying relatively large batches of leafy vegetables or other non-packing materials in a minimum amount of time.

Still another object of the invention is to provide such apparatus which can receive material from and deliver processed material to conveyors which may approach the apparatus from a variety of different directions.

Yet another object of the invention is to provide a spin dryer of this type which is fully automatic.

A further object of the invention is to provide an automatic spin dryer which is relatively easy and inexpensive to maintain.

Other objects will, in part, be obvious and will, in part, appear hereinafter. The invention accordingly comprises the features of construction, combination of elements and arrangement of parts which will be exemplified in the following detailed description and the scope of the invention will be indicated in the claims.

We will describe our invention in terms of a fully automatic spin dryer for dewatering and drying material such as leafy vegetables which have bulk and little tendency to pack, e.g., spinach, cole slaw, salad mix, etc. It should be understood, however, that aspects of the invention have application to basket-type centrifugal seperators generally.

Briefly, our centrifugal seperator or dryer is supported above the ground by a self-centering pendulum suspension which minimizes vibration during operation of the dryer. The dryer includes a relatively large housing having side walls, a flat top wall and a flat annular bottom wall. A basket, positioned inside the housing, is connected to a spindle rotatably suspended from the housing top wall so that the basket can be rotated about a vertical axis. Also, a pneumatic brake is associated with the spindle so that the spindle, and therefore the basket, may be braked to a stop at the end of each spin cycle.

An opening is provided in the housing top wall through which the material to be dried, e.g., spinach, may be dropped from a conveyor into the basket prior to the beginning of each spin cycle.

In accordance with the invention, the basket is provided with a conical bottom wall which is moveable, by means of a pneumatic cylinder mounted to the underside of that bottom wall, between an upper position wherein the bottom wall engages and seals against the lower edge of the basket side walls thereby closing the bottom of the basket and a lower position wherein the bottom wall is spaced well below the basket side wall so that the material in the basket can drop down onto a conveyor belt positioned below the separator housing at the end of a spin cycle.

Due to the specific design of the separator and its support, material can be conveyed to and from the separator basket in a number of different directions which greatly simplifies the placement of the apparatus in a building. Also, the placement of the pneumatic cylinder which opens and closes the basket bottom wall at the underside of the basket reduces appreciably the overall height of the apparatus so that the apparatus can be located in a building having a standard ceiling height. As will be described in detail later, this arrangement also strengthens the connection of the basket bottom wall to the spindle which rotates the basket. While achieving all these advantages, since essentially all of the moving elements of the dryer are accessible from the top of the dryer, the apparatus is still relatively easy to clean and to maintain.

Our dryer incorporates controls which render it fully automatic. It has a feed or load cycle during which a selected amount of the material to be processed is deposited from a conveyor into the basket while the basket rotates at a relatively slow speed to distribute the material evenly in the basket. Then, the dryer automatically commences a spin cycle wherein the basket is rotated at high speed for a selected period of time or for a time determined by the weight of the basket contents. During this cycle, the water or other liquid is centrifugally separated from the solid material in the basket and drained away. The basket is then braked to a stop and the basket bottom wall is moved automatically to its open position, allowing the dried basket contents to drop onto a conveyor for transport toward its ultimate destination. Provision is made for rotating the basket at the slower feed rate while the bottom wall is open to fling out any residual material in the basket or on the basket bottom wall following which the basket bottom wall is closed in preparation for the next feed cycle.

Due to its fully automatic operation, our dryer is capable of processing material at a rate as high as one batch per minute, a batch for a dryer having a 40 inch diameter basket consisting of as much as 2¾ bushels of produce, e.g., spinach. Actually, the efficiency of our dryer is such that it may replace up to 4 conventional dryers and the 1–2 people required to service them. Therefore, our dryer should have many applications in the marketplace.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
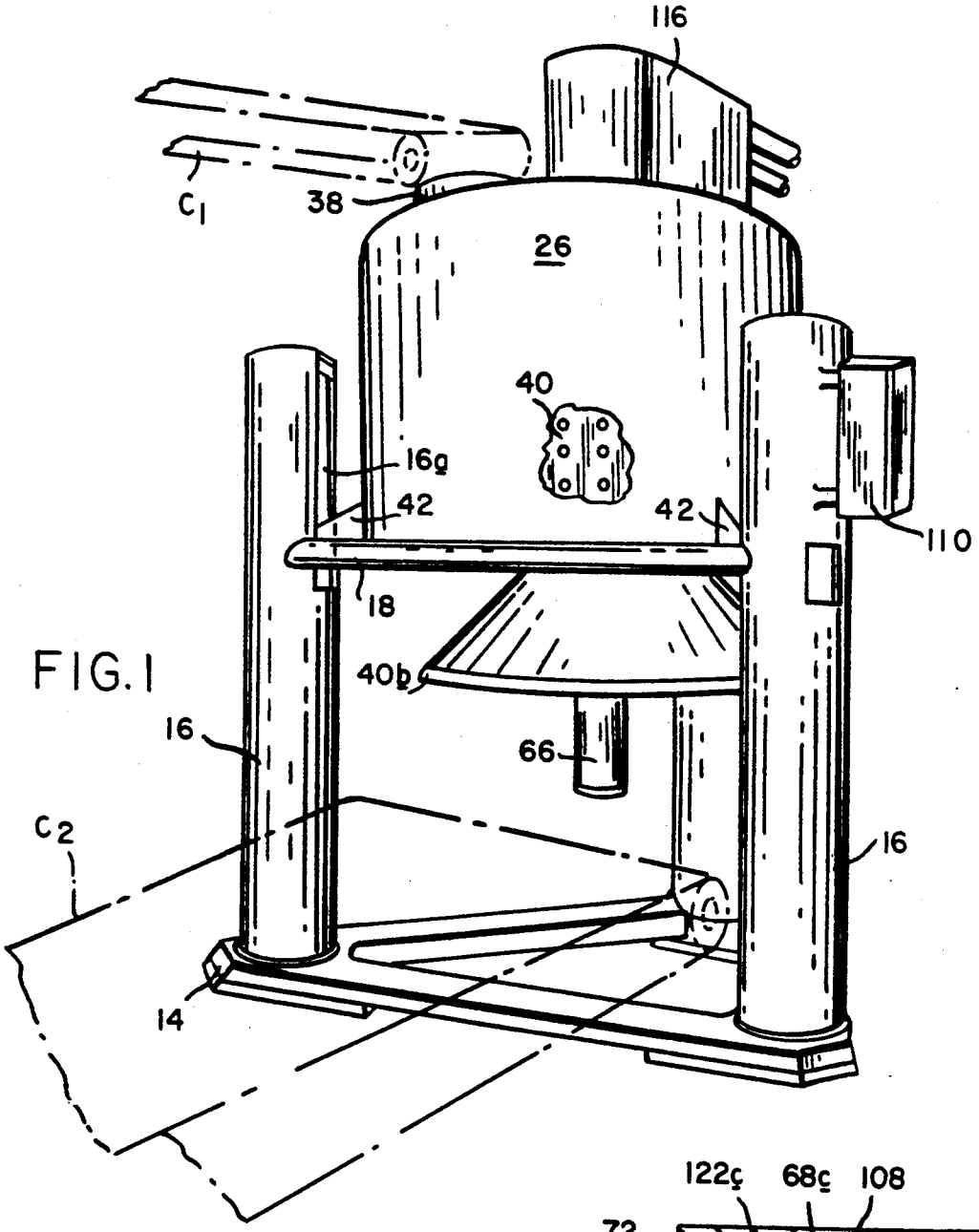
FIG. 1 is an isometric view, with parts broken away, showing a centrifugal separator incorporating the invention.
Figure 2:
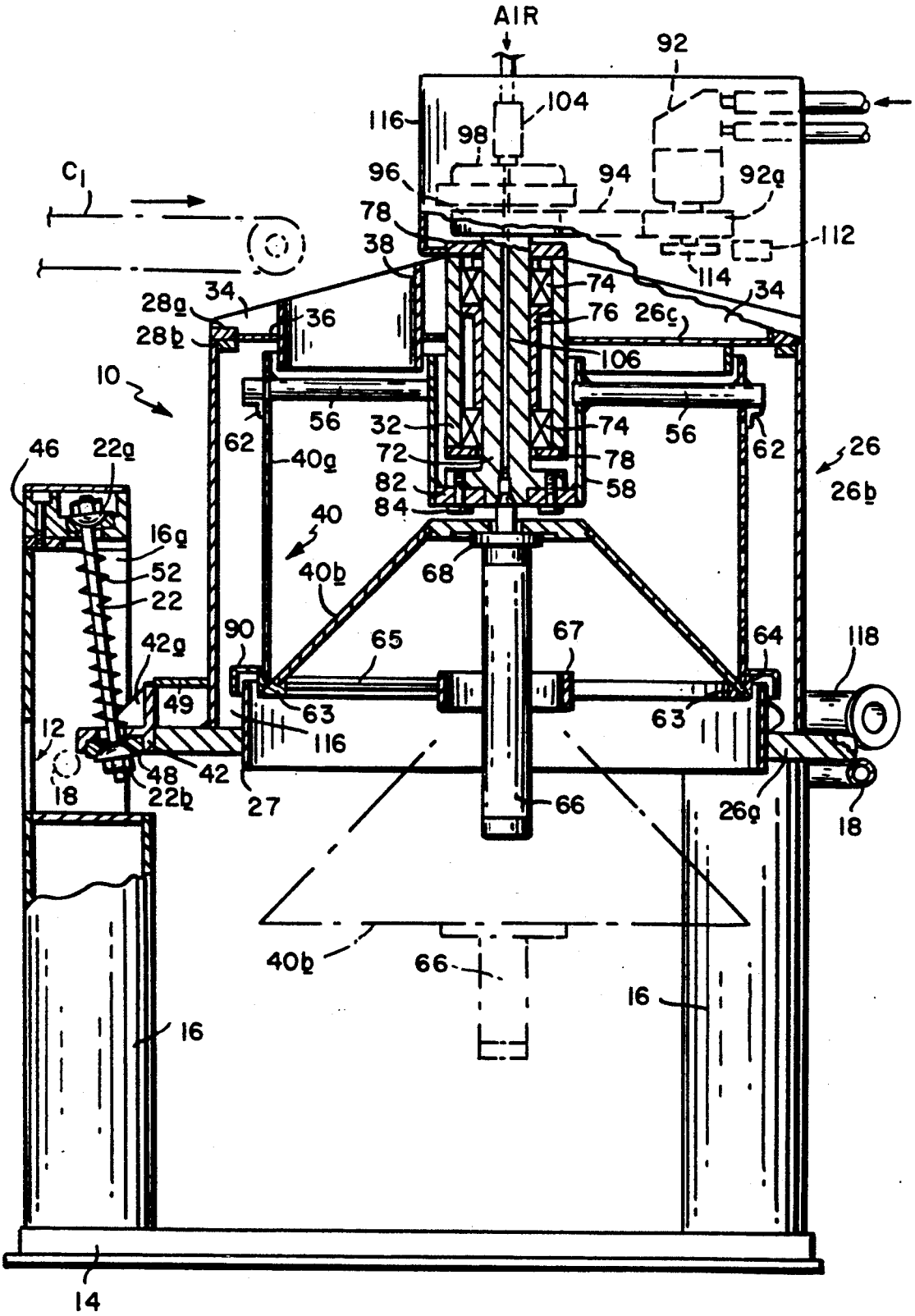
FIG. 2 is a vertical sectional view, with parts in elevation, showing certain elements of the separator in greater detail.

Referring to FIGS. 1 and 2 of the drawings, the centrifugal separator or dryer shown generally at 10 includes a support structure indicated generally at 12. The support structure comprises a generally triangular base 14 and three posts 16 extending up vertically from the three corners of the base. A ring 18 of pipe is connected to the posts about a third of the way down from the tops thereof to strengthen the support structure. The separator 10 is suspended from posts 16 by three link rods 22 positioned inside the posts as best seen in FIG. 2.

Separator 10 includes a large generally cylindrical housing 26 having a flat, rigid annular bottom wall **26*a* and a generally cylindrical side wall 26*b* butt-welded to the top of bottom wall 26*a*. For reasons that will become apparent, a short cylindrical skirt 27 is welded to the inside edge of wall 26*a* so that the skirt extends above and slightly below wall 26*a***.

A pair of flat rigid rings **28*a* and 28*b* are welded to the upper edge of housing side wall 26*b*. Positioned concentric to these rings is a tubular spindle housing 32. Also, series of vertically oriented gussets 34 extend radially from housing 32 to ring 28*a* at spaced-apart locations around the circumference of that ring, with the gussets being welded to the housing 32 and the ring 28*a*** to provide a very strong strut-like load bearing structure able to support all of the moving components of the dryer to be described shortly.

The housing 26 also has a top wall **26*c* which extends across the top of the housing inside rings 28*a* and 28*b*. An opening 36 is provided in that top wall for accommodating a vertical chute 38 through which the materials be dried may be dropped into a basket 40 rotatably mounted inside housing 26**. All of the components of the dryer likely to be in contact with the material being processed may be made of a strong, nonoxydizing material which is easy to clean, e.g., stainless steel.

The link rods 22 which support the dryer are connected between the upper ends of posts 16 and L-shaped brackets 42 welded to the periphery of the housing bottom wall **26*a* at locations thereon that are directly opposite the posts. More specifically, the upper end of each link rod 22 carries a hemispherical ball 22*a* which seats in a cup 44 recessed in a mounting plate 46 at the top of the corresponding post 16. A similar ball 22*b* at the lower end of each link rod seats in a ball seat cup 48 present in the corresponding bracket 42. Preferably, each bracket 42 includes a rigidifying gusset or web 42*a* extending between its two legs and a plate 49 welded between the vertical bracket leg and the housing side wall 26*b***.

The link rods 22 are tilted toward the axis of housing 26 and they each carry a spring 52 to bias the brackets 42, and therefore the separator as a whole, downward so that the dryer 10 tends to repose in a level state or position. This resilient pendulum type connection of the dryer 10 to its support structure 12 minimizes vibrations due to an unbalanced load in basket 40 when the dryer is in operation.

Still referring to FIG. 2, the dryer basket 40 comprises a generally cylindrical perforate side wall **40*a* which is connected near its upper edge by radial spokes 56, e.g., pipes, to a central tubular hub 58 which encircles the spindle housing 32. The ends of the spokes may be welded to the basket side wall 40***a* and hub 58, respectively, and preferably a reinforcing ring 62 encircles the basket 40*a* just below the spokes 56, being welded to the basket side wall 40*a* and to the spokes to reinforce the upper portion of the basket 40.

Basket 40 has a generally conical, imperforate bottom wall 40*b* which is moveable vertically from a raised or closed position shown in solid lines in FIG. 2 and a lower or open position shown in phantom in that same figure and in solid lines in FIG. 1. When that bottom wall is in its raised position, an annular seal member 63 at its outer edge seats and seals against a mating sealing ring 64, containing a gasket 64*a*, mounted to the lower edge of housing side wall 40*a*. To strengthen bottom wall 40*b*, and its seal member, the bottom wall is provided with a plurality of radial spokes 65 which extend between seal member 63 and a hub 67 which is coaxial with basket hub 58. When the bottom wall 40*b* is in its lower or open position, material is free to drop out of basket 40 under gravity.

The basket bottom wall 40*b* includes a flat central area which is mounted to the pneumatic cylinder 66 of a piston which extends down through hub 67 with appreciable clearance. A piston rod 68 extending from the cylinder 66 is connected to the lower end of a rotary spindle 72 in hub 58 in a manner to be described later. Spindle 72 is rotatably mounted within the spindle housing 32. For this, upper and lower bearing units 74 are provided inside that housing around spindle 72 and held in vertically spaced relation by a spacer 76. The upper unit may incorporate ball bearings; the lower unit preferably comprises spherical roller bearings. Upper and lower bearing caps 78 close off the upper and lower ends of housing 32.

The hub 58 of the basket 40 is also arranged to rotate with spindle 72. For this, the hub is provided with a flat annular end wall 82 which is seated against the lower end of spindle 72 and retained there by threaded fasteners 84. Thus, when spindle 72 is rotated, basket 40, including its bottom wall 40*b* and the pneumatic cylinder 66, rotate within housing 26. As best seen in FIG. 2, a ring 90 having an L-shaped cross-section encircles the lower end of the basket side wall 40*a* to form a lip which overhangs the upper end of skirt 27 to prevent the basket contents from being flung out radially when the basket is rotated with its bottom wall in the open position.

Spindle 72 is preferably rotated by a hydraulic motor 92 supported above housing 26. The motor rotates a sheave 92*a* which drives one or more belts 94 which rotates a second sheave 96 mounted to the upper end of spindle 72. A pneumatic brake 98 is also present at the upper end of spindle 72 for stopping rotation of the spindle and the basket 40.

The air for operating the pneumatic cylinder 66 is delivered by an air hose 102 connected by a rotary union 104 to an axial passage 106 in spindle 72 which communicates with a similar passage 108 (FIG. 3) in the rod 68 of pneumatic cylinder 66. When the cylinder is pressurized, the basket wall 40*b* is maintained in its upper, closed position. When the air is released, the rod 68 extends and wall 40*b* drops under gravity to its lower, open position. The deliveries of air to hose 102 and brake 98, are controlled by a controller 110, which includes a microprocessor, mounted to one of the posts 16 as shown in FIG. 1. The controller 110 also receives an input signal from a tachometer 112 which senses the teeth of a tachometer gear 114 mounted to rotate with the motor sheave 92*a*. The signals from tachometer 112 are indicative of the rotary speed of basket 40. Preferably, the motor 92, brake 98 and the components ancillary thereto are enclosed by a cover 116.

Figure 3:
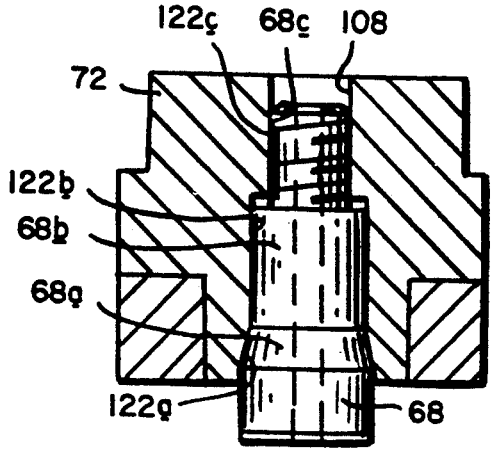
FIG. 3 is a similar view on a much larger scale showing the connection of the basket bottom wall to the spindle of the FIG. 2 separator.

Referring now to FIG. 3, to ensure a secure connection of the piston rod 68 to spindle 72, the rod extends into an axial passage 122 in the lower end of the spindle. The rod and the spindle passage have conically tapered segments 68*a* and 122*a*, respectively, cylindrical segments 68*b* and 122*b* and reduced diameter correspondingly threaded end segments 68*b* and 122*c* respectively. Thus, the rod may be screwed into the passage 122 until the tapered rod segment 68*a* seats tightly against the wall of the passage tapered segment 122*a*. This arrangement provides a connection which suffers minimum stress particularly when the basket 40 is rotated with its bottom wall 40*b* in the open position.

During operation of the centrifugal separator or dryer, with the basket bottom wall 40*b* in its upper, closed position shown in solid lines in FIG. 2, the material to be processed, e.g., salad mix, is dropped through chute 38 into the basket. Preferably, this feed operation is done automatically using a moving conveyor belt such as the belt $C_1$ shown in phantom in FIGS. 1 and 2. During the feed operation, it is also desirable to operate the dryer at a relatively low speed, e.g., 30 RPM, to distribute the wet product evenly throughout the basket 40. The feed cycle may be performed on a time basis or it may be based on the weight of the product introduced into the basket as measured by a suitable scale (not shown). At the end of the feed cycle, the dryer automatically initiates a spin cycle so that the basket 40 is accelerated to drying speed e.g., 1100 RPM, and spins at that speed for a pre-determined time period.

During the spin cycle, the resultant centrifugal force thrusts the basket contents radially outward to the perforate basket sidewall 40*a*. The solid material is retained by the side wall 40*a*, while the water or other liquid passes through the side wall and collects in an annular trough 116 at the bottom of housing 26 just outboard of the skirt 27. A drain pipe 118 is connected to the housing side wall 40*a*, opening into the trough, to drain away that liquid by gravity. Both the drying speed and the spin time may be varied to ensure optimal processing results for the different material batches.

When the spin cycle is completed, a discharge cycle is automatically initiated by the controller 110. For this, the drive motor 92 is de-energized and air is supplied to the air brake 98 so as to slow down the basket 40. When the speed of the basket reaches, e.g., 100 RPM, as determined by the signals from tachometer 112, air is released from the pneumatic cylinder 66. It takes about five seconds for the air to exhaust from cylinder 66 while the basket bottom wall 40*b* drops down to its lower position shown in phantom in FIG. 2. Thus, basket 40 is braked to a stop at just about the time that the basket bottom wall 40*b* reaches its fully open position. Resultantly, the material in the basket drops out the bottom of the basket, preferably onto a moving conveyor $C_2$ shown in phantom in FIG. 1 and is carried away from the apparatus.

If desired, controller 110 may be programmed to rotate basket 40 at the loading speed, i.e., 30 RPM, while the bottom wall 40*b* is in its open position so that any residual material in the basket will be encouraged to drop from the basket. Then, air is supplied to cylinder 66 causing the cylinder to retract rod 68 thereby moving the basket bottom wall 40*b* to its closed position shown in solid lines in FIG. 2 in preparation for the next feed or loading cycle.

It will thus be seen that the objects set forth above, among those made apparent from the preceeding description are efficiently attained and, since certain changes may be made in the above construction without departing from the scope of the invention, it is intended that all matter contained in the above description or shown in the accompanying drawings shall be interpreted as illustrative and not in limiting sense.

I claim:

1. Centrifugal separating apparatus for drying objects, said apparatus comprising a support including at least three upstanding posts with lateral spaces between the post for providing clearance for a conveyor extending from the dryer in at least one of three directions;

a housing having a annular bottom wall, a side wall and a top wall with an opening therein;

pendulum-type suspension means extending from each of the posts to the housing for suspending the housing between the post;

an open-top basket inside the housing, said basket having a cylindrical side wall and a conical bottom wall which is moveable along a vertical axis between a closed position wherein the periphery of the bottom wall seals against the lower edge of the basket side wall and an open position wherein the bottom wall is spaced depreciably below the basket side wall;

rotating means for rotating said basket about its said axis, and moving means for moving said bottom wall between its said positions so that when the bottom wall is in its open position, the contents of the basket can fall onto a conveyor positioned underneath said bottom wall.

2. The apparatus defined in claim 1 wherein the moving means extend below said basket bottom wall.

3. The apparatus defined in claim 2 wherein said moving means comprise a piston including a cylinder and a piston rod;

means for connecting the cylinder to the basket bottom wall, and means for securing said rod to the rotating means.

4. The apparatus defined in claim 3 wherein the rotating means include a spindle having an upper end portion rotatably suspended from the housing top wall and a lower end, and motive means for rotating said spindle.

5. The apparatus defined in claim 4 wherein the securing means include a threaded and conically shaped axial passage in said lower end of the spindle, and a correspondly threaded and shaped end segment of said piston rod turned into said passage.

6. A centrifugal separator comprising a housing having an annular bottom wall, a side wall and a top wall having an opening therein;

means for supporting the housing above the ground;

an open-top basket positioned in the housing, said basket having a cylindrical side wall and a conical bottom wall which is moveable along a vertical axis between a closed position wherein the periphery of the bottom wall seals against the lower edge of the side wall and an open position wherein the bottom wall is spaced appreciably below the basket side wall;

rotating means for rotating said basket about its said axis, said rotating means including a spindle having an upper end portion vertically suspended from the housing top wall and a lower end, and motive means for rotating the spindle, and moving means suspended below the basket bottom wall for moving the basket bottom wall between its said two positions, said moving means including a piston including a cylinder and a piston rod;

means for connecting the cylinder to the basket bottom wall, and means for securing the rod to the rotating means, said securing means including a threaded and conically shaped axial passage in said lower end of the spindle and a correspondingly threaded and shaped end segment of said piston rod turned into said passage.

7. The apparatus defined in claim 1 and further including a conveyor for conveying said objects to said opening in the top wall.

8. The apparatus defined in claim 1 and further including a conveyor positioned underneath said bottom wall.

* * * * *